US010351999B2

(12) United States Patent
Laborenz et al.

(10) Patent No.: US 10,351,999 B2
(45) Date of Patent: Jul. 16, 2019

(54) SLEEPER BLOCK UNIT FOR RAILWAY TRACK SYSTEMS

(71) Applicant: Sonneville AG, Luterbach (CH)

(72) Inventors: Peter Laborenz, Lüscherz (CH); Anabel Catrin Hengelmann, Zürich (CH)

(73) Assignee: SONNEVILLE AG (CH)

( * ) Notice: Subject to any disclaimer, the term of this patent is extended or adjusted under 35 U.S.C. 154(b) by 156 days.

(21) Appl. No.: 15/529,274

(22) PCT Filed: Jan. 11, 2016

(86) PCT No.: PCT/EP2016/050374

§ 371 (c)(1),
(2) Date: May 24, 2017

(87) PCT Pub. No.: WO2016/113218

PCT Pub. Date: Jul. 21, 2016

(65) Prior Publication Data

US 2017/0260697 A1 Sep. 14, 2017

(30) Foreign Application Priority Data

Jan. 14, 2015 (EP) ..... 15151142

(51) Int. Cl.
*E01B 1/00* (2006.01)
*E01B 3/40* (2006.01)

(52) U.S. Cl.
CPC ..... *E01B 1/005* (2013.01); *E01B 3/40* (2013.01)

(58) Field of Classification Search
CPC ..... E01B 1/00; E01B 1/005; E01B 3/40
See application file for complete search history.

(56) References Cited

U.S. PATENT DOCUMENTS

2013/0277441 A1* 10/2013 Laborenz ..... E01B 1/004 238/3
2016/0017544 A1* 1/2016 Hengelmann ..... E01B 3/28 238/55

(Continued)

FOREIGN PATENT DOCUMENTS

DE 43 35 516 A1 4/1995
DE 297 19 400 U1 2/1998

(Continued)

OTHER PUBLICATIONS

International Search Report dated May 9, 2016 in corresponding PCT International Application No. PCT/EP2016/050374.

(Continued)

*Primary Examiner* — Jason C Smith
(74) *Attorney, Agent, or Firm* — Ostrolenk Faber LLP

(57) ABSTRACT

A sleeper block unit including a sleeper block and a sleeper shoe that surrounds the latter in its lower area. In the area of the upper edge of the side walls (9) of the sleeper shoe, a surrounding sealing collar (14) of an elastic material is arranged which sealingly connects the sleeper block to the sleeper shoe. The sealing collar (14) includes an upper edge section (15), a lower edge section (16), and a lateral section (17) arranged therebetween. In the area of the upper edge of the side walls (9) of the sleeper shoe (3), a surrounding bead (11) is externally arranged which is sealingly overlapped by the lower edge section of the sealing collar (14).

20 Claims, 1 Drawing Sheet

(56) References Cited

U.S. PATENT DOCUMENTS

| | | | | |
|---|---|---|---|---|
| 2017/0260697 | A1* | 9/2017 | Laborenz | E01B 3/40 |
| 2017/0314208 | A1* | 11/2017 | Raymond | E01B 3/40 |

FOREIGN PATENT DOCUMENTS

| | | | |
|---|---|---|---|
| DE | 101 96 374 | B4 | 1/2012 |
| EP | 0 603 927 | A2 | 6/1994 |
| EP | 0 557 870 | B1 | 5/1996 |
| EP | 0 915 202 | A1 | 5/1999 |
| EP | 1 017 906 | B1 | 12/2003 |
| FR | 2 740 788 | A1 | 5/1997 |

OTHER PUBLICATIONS

Written Opinion dated May 9, 2016 in corresponding PCT International Application No. PCT/EP2016/050374.

* cited by examiner

SLEEPER BLOCK UNIT FOR RAILWAY TRACK SYSTEMS

CROSS-REFERENCE TO RELATED APPLICATIONS

The present application is a 35 U.S.C. §§ 371 national phase conversion of PCT/EP2016/050374, filed Jan. 11, 2016, which claims priority to European Patent Application No. 15151142.5, filed Jan. 14, 2015, the contents of which are incorporated herein by reference. The PCT International Application was published in the English language.

TECHNICAL FIELD

The invention relates to a sleeper block unit for railway track systems, including a sleeper block and a sleeper shoe that surrounds the sleeper block in its lower area and comprises a bottom and four side walls, a surrounding sealing collar of an elastic material being arranged in the area of the upper edge of the side walls which sealingly connects the sleeper block to the sleeper shoe.

BACKGROUND OF THE INVENTION

Sleeper block units are used in so-called slab tracks which are increasingly preferred to so-called ballasted tracks since they allow an increased performance of the track with regard to the attainable speeds and reduced maintenance costs. Such sleeper block units comprise a sleeper block generally made of concrete, a shoe generally made of shaped rubber that receives the sleeper block, and an elastomer pad that is arranged between the bottom of the sleeper block and the bottom of the sleeper shoe. On the upper side of the sleeper block, a fastening system for a rail is arranged. The sleeper shoe is encased in concrete.

In patent DE10196374B4 it is explained that in such sleeper block units the dynamic to static rigidity ratio increases with the vertical movement of the block and therefore the deformation of the elastomer pad under dynamic loads is impeded by an interface between the block and the shoe wall, and that this interface is a phenomenon known as the wedge effect. The cited patent then describes a solution for eliminating the wedge effect without reducing the lateral resistance of the track and for decreasing the dynamic to static rigidity ratio. It is evident that the rigidity and the damping behavior of a sleeper block unit are adversely influenced particularly when solid particles such as sand, dust, dirt, abraded concrete etc. enter between the block and the shoe. Therefore, measures aiming to seal the space between the block and the shoe against the exterior have already been suggested.

The references EP1017906B1 and DE4335516A1 both show a sleeper block having a partly surrounding sleeper shoe where a resilient sealing lip lying against the substantially vertically oriented outer wall of the sleeper block is arranged at the upper edge of the sleeper shoe. These arrangements suffer from the disadvantage that during vertical movements of the sleeper block, the sealing lip rubs against the outer wall of the sleeper block and is therefore subject to wear so that the sealing effect decreases over time. The reference EP0915202A1 describes a sleeper block and sleeper shoe assembly where the latter has a surrounding sealing arrangement at its upper edge that sealingly engages in a dedicated surrounding groove in the sleeper block. This groove complicates the manufacture of the sleeper block.

In the reference DE4335516A1 it is also suggested to additionally seal the junction between the sleeper block and the shoe by means of an adhesive strip. On one hand, the attachment of the adhesive strips involves considerable labor during the construction of a slab track, and on the other hand, it is to be expected that the sealing effect of the adhesive strips will decrease over time.

The reference EP0557870B1 describes a solution where a surrounding sealing frame of an elastic material is provided in the area of the upper edges of the sleeper block side walls, whose lower edge section overlaps the upper edge of the sleeper shoe side walls externally and which is sealingly connected thereto, and whose upper edge section is sealingly connected to the lateral surfaces of the sleeper block. More specifically, this upper edge section of the sealing frame may be encased in the sleeper block, and the lower edge section is preferably connected to the sleeper shoe by bonding or welding. In addition, as shown in FIG. 2 of the document, the junction area of the sealing frame is covered by the surrounding concrete. Although this arrangement ensures the required tightness, it entails considerable difficulties when a sleeper block needs to be replaced. Lifting out a sleeper block requires a substantial force whereby the sealing frame will generally be destroyed so that fragments of the sealing frame will inevitably be left on the sleeper shoe and make it even more difficult to tightly attach a new sealing frame to the sleeper shoe. Correspondingly, the insertion of a new sleeper block will be problematic, and a reliable seal of the new sleeper block can only be achieved by partly removing the surrounding concrete and re-encasing the sleeper shoe when the sealing frame of the new sleeper block has been bonded or welded, respectively.

SUMMARY OF THE INVENTION

On the background of this prior art, it is the object of the invention to provide a sleeper block unit of the kind mentioned in the introduction where the sealing effect between the sealing collar and the sleeper shoe is also ensured after a replacement of the sleeper block.

According to the invention, this object is achieved in that the sealing collar comprises an upper edge section, a lower edge section, and a lateral section arranged therebetween, in that a surrounding bead is arranged externally in the area of the upper edge of the side walls of the sleeper shoe, and in that the lower edge section of the sealing collar overlaps the bead and lies against the bead at least in an area situated below the largest horizontal dimension of the bead.

In particular, this inventive solution offers the advantage that the sealing effect between the sealing collar and the sleeper shoe is also ensured without a bonded or welded connection since the concrete that surrounds the sleeper shoe is cast up to the lower edge of the sealing collar and thus presses the latter against the bead of the sleeper shoe. As a result, it is possible to replace a sleeper block without renewing the surrounding concrete. Moreover, in the sleeper block unit according to the invention, barely any sliding friction arises between the sealing collar and the sleeper shoe during load variations so that the sealing effect is also ensured without a bonded or welded connection. Any sliding friction is largely avoided by the fact that the lateral section of the sealing collar is bent when the sleeper block is pressed down under load. Another advantage is that the sleeper shoe is fixed to the sleeper block by the sealing collar overlapping the bead before the track is assembled so that fixing means such as adhesive strips or cable ties, as they have been used until now for temporarily retaining the sleeper shoe on the sleeper block, may be omitted.

BRIEF DESCRIPTION OF THE DRAWINGS

An exemplary embodiment of the invention will be described in more detail hereinafter with reference to the appended drawings showing FIG. 1 a view of the long side of a sleeper block unit.

DESCRIPTION OF PREFERRED EMBODIMENTS

Figure 1:
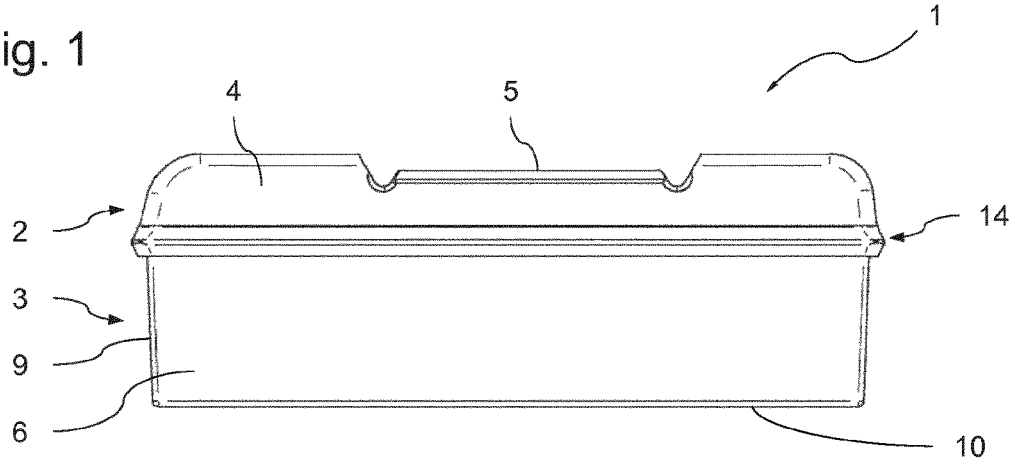
Figure 2:
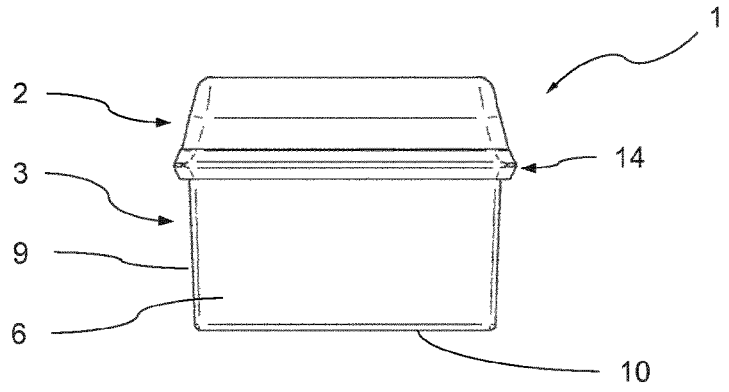
FIG. 2 a view of the short side of the same sleeper block unit.

FIGS. 1 and 2 show side elevations of an exemplary embodiment of a sleeper block unit 1 according to the invention showing the long and the short side of sleeper block unit 1, respectively, that has a substantially rectangular plan view. Sleeper block unit 1 is similar to the one described in the reference DE10196374B4 and includes a sleeper block 2 made of concrete and a sleeper shoe 3 that surrounds the latter on part of its height and is made of an elastomeric material, preferably of rubber. Sleeper block 2 has a head portion 4 with a bearing surface 5 for rail fastening means (not shown). Furthermore, in the present example, sleeper block 2 comprises a base portion 6 that is shorter and narrower than head portion 4 so that a step 7 (FIG. 3) is formed between head portion 4 and base portion 6. The junction area 8 between the side wall surfaces of base portion 6 and step 7 is preferably rounded as illustrated. The side wall surfaces of base portion 6 are slightly inclined such that the length and the width of base portion 6 decrease toward the bottom. This allows replacing sleeper block unit 1 without the need of breaking up the surrounding concrete. Sleeper shoe 3 has four side walls 9 and a bottom 10, and between bottom surface of sleeper block 2 and bottom 10 of sleeper shoe 3, a resilient inlay that is not shown in the drawing is arranged which in operation under load allows a vertical movement of sleeper block 2 in sleeper shoe 3.

Figure 3:
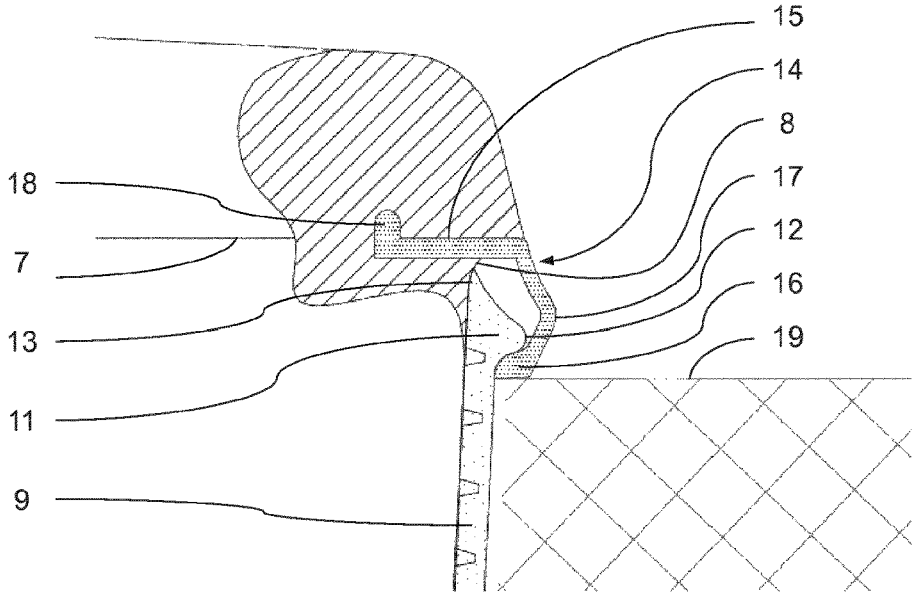
FIG. 3 a partly sectioned detail of FIG. 1 or 2, respectively, on an enlarged scale.

FIG. 3 shows an enlarged, partly sectioned detail of the upper edge of a side wall 9 of sleeper shoe 3. On the outside of side wall 9, a surrounding bead 11 is arranged which is preferably rounded as illustrated. Reference numeral 12 denotes a line that extends perpendicularly to the plane of the drawing and corresponds to the apex of bead 11 and thus to the largest horizontal dimension of bead 11 and consequently also of sleeper shoe 3. Above bead 11, side wall 9 is terminated by a tapering lip 13 that lies against sleeper block 2. This lip serves as an aid while sealing collar 14 is being slipped over sleeper shoe 3, either during first assembly or after a replacement of sleeper block 2 in an existing track.

A sealing collar 14 of an elastomeric material, preferably rubber, bridges the upper edge of side walls 9 of sleeper shoe 3. Sealing collar 14 has a horizontally oriented upper edge section 15 followed by a substantially vertically oriented lateral section 17 and a lower edge section 16 that is inclined toward side wall 9 of sleeper shoe 3. The latter edge section is preferably a little thicker than lateral section 17, as illustrated. Upper edge section 15 is encased in sleeper block 2, and anchoring elements 18 additionally enhance the connection between sleeper block 2 and sealing collar 14. In FIG. 3, a rib-shaped anchoring element 18 is shown, but it is also possible to use anchoring elements in the form of recesses or apertures in upper edge section 15. In the illustration of FIG. 3, the sleeper block unit is encased in concrete, reference numeral 19 denoting the level of the infill concrete.

In operation, when the arrangement of FIG. 3 is loaded by a passing train, sleeper block 2 will be slightly pressed down in sleeper shoe 3 and will entrain the upper edge section 15 of sealing collar 14 encased in sleeper block 2 while the lower edge section 16 of sealing collar 14 remains in the depicted position and remains in contact with bead 11. The level 19 of the infill concrete surrounding sleeper shoe 19 helps to prevent that the lower edge section 16 of the sealing collar loses contact with bead 11. As a result, as the upper edge section 15 of sealing collar 14 slightly approaches the lower edge section 16 due to the downward movement of sleeper block 2 in sleeper shoe 3, lateral section 17 of sealing collar 14 will resiliently yield. Lateral section 17 may basically be straight in shape and vertically oriented. However, in order to promote the aforementioned resilient yielding, lateral section 17 is preferably outwardly vaulted, i.e. away from sleeper shoe 3, as illustrated. Therefore, under load, a bending stress of lateral section 17 results, whereby an undesired sliding friction between sealing collar 14 and sleeper shoe 3 is also prevented.

- - -

LIST OF REFERENCE NUMERALS

1 sleeper block unit
2 sleeper block
3 sleeper shoe
4 head portion
5 bearing surface
6 base portion
7 step
8 junction area
9 side wall of 3
10 bottom of 3
11 bead
12 apex of 11
13 lip
14 sealing collar
15 upper edge section of 14
16 lower edge section of 14
17 lateral section of 14
18 anchoring element
19 level

The invention claimed is:

1. A sleeper block unit for railway track systems, including a sleeper block and a sleeper shoe that surrounds the sleeper block in its lower area and comprises a bottom and four side walls, a surrounding sealing collar of an elastic material being arranged in the area of the upper edge of the side walls, which sealingly connects the sleeper block to the sleeper shoe, wherein:

the sealing collar comprises an upper edge section, a lower edge section, and a lateral section arranged therebetween, a surrounding bead is arranged externally in the area of the upper edge of the side walls of the sleeper shoe, the lower edge section of the sealing collar overlaps the bead and lies against the bead at least in an area situated below the largest horizontal dimension of the bead, and the lower edge section of the sealing collar is thicker than its lateral section.

2. The sleeper block unit according to claim 1, wherein the upper edge section of the sealing collar is encased in the sleeper block.

3. The sleeper block unit according to claim 2, wherein the upper edge section of the sealing collar has anchoring elements.

4. The sleeper block unit according to claim 1, wherein the lateral section of the sealing collar is vaulted away from the sleeper shoe.

5. The sleeper block unit according to claim 1, wherein the lower edge section of the sealing collar is oriented at an angle of 30 degrees to 60 degrees relative to the exterior of the side wall of the sleeper shoe.

6. The sleeper block unit according to claim 1, wherein the sleeper block has a head portion and a base portion, the head portion being longer and larger than the base portion such that a step results between the head portion and the base portion.

7. The sleeper block unit according to claim 6, wherein the upper surface of the upper edge section of the sealing collar is flush with the step.

8. The sleeper block unit according to claim 1, wherein, above the bead, the side walls of the sleeper shoe are terminated by a upwardly tapering lip that lies against the sleeper block.

9. A sleeper block unit for railway track systems, including a sleeper block and a sleeper shoe that surrounds the sleeper block in its lower area and comprises a bottom and four side walls, a surrounding sealing collar of an elastic material being arranged in the area of the upper edge of the side walls, which sealingly connects the sleeper block to the sleeper shoe, wherein:

the sealing collar comprises an upper edge section, a lower edge section, and a lateral section arranged therebetween, a surrounding bead is arranged externally in the area of the upper edge of the side walls of the sleeper shoe, the lower edge section of the sealing collar overlaps the bead and lies against the bead at least in an area situated below the largest horizontal dimension of the bead, and the lower edge section of the sealing collar is oriented at an angle of 30 degrees to 60 degrees relative to the exterior of the side wall of the sleeper shoe.

10. The sleeper block unit according to claim 9, wherein the upper edge section of the sealing collar is encased in the sleeper block.

11. The sleeper block unit according to claim 10, wherein the upper edge section of the sealing collar has anchoring elements.

12. The sleeper block unit according to claim 9, wherein the lateral section of the sealing collar is vaulted away from the sleeper shoe.

13. The sleeper block unit according to claim 9, wherein the sleeper block has a head portion and a base portion, the head portion being longer and larger than the base portion such that a step results between the head portion and the base portion.

14. The sleeper block unit according to claim 13, wherein the upper surface of the upper edge section of the sealing collar is flush with the step.

15. A sleeper block unit for railway track systems, including a sleeper block and a sleeper shoe that surrounds the sleeper block in its lower area and comprises a bottom and four side walls, a surrounding sealing collar of an elastic material being arranged in the area of the upper edge of the side walls, which sealingly connects the sleeper block to the sleeper shoe, wherein:

the sealing collar comprises an upper edge section, a lower edge section, and a lateral section arranged therebetween, a surrounding bead is arranged externally in the area of the upper edge of the side walls of the sleeper shoe, the lower edge section of the sealing collar overlaps the bead and lies against the bead at least in an area situated below the largest horizontal dimension of the bead, and above the bead, the side walls of the sleeper shoe are terminated by a upwardly tapering lip that lies against the sleeper block.

16. The sleeper block unit according to claim 15, wherein the upper edge section of the sealing collar is encased in the sleeper block.

17. The sleeper block unit according to claim 16, wherein the upper edge section of the sealing collar has anchoring elements.

18. The sleeper block unit according to claim 15, wherein the lateral section of the sealing collar is vaulted away from the sleeper shoe.

19. The sleeper block unit according to claim 15, wherein the sleeper block has a head portion and a base portion, the head portion being longer and larger than the base portion such that a step results between the head portion and the base portion.

20. The sleeper block unit according to claim 19, wherein the upper surface of the upper edge section of the sealing collar is flush with the step.

* * * * *